US010311689B1

(12) United States Patent
Meganathan et al.

(10) Patent No.: US 10,311,689 B1
(45) Date of Patent: Jun. 4, 2019

(54) SYSTEMS AND METHODS FOR PROTECTING A BYPASSED ZONE IN A SECURITY SYSTEM OR A CONNECTED HOME SYSTEM

(71) Applicant: Honeywell International Inc., Morristown, NJ (US)

(72) Inventors: Deepak Sundar Meganathan, Bangalore (IN); Hemanth Padikkal Veettil, Bangalore (IN); Shaiju Janardhanan, Bangalore (IN)

(73) Assignee: ADEMCO INC., Golden Valley, MN (US)

( * ) Notice: Subject to any disclaimer, the term of this patent is extended or adjusted under 35 U.S.C. 154(b) by 0 days.

(21) Appl. No.: 15/874,225

(22) Filed: Jan. 18, 2018

(51) Int. Cl.
*G08B 13/08* (2006.01)
*G08B 25/00* (2006.01)

(52) U.S. Cl.
CPC ..... *G08B 13/08* (2013.01); *G08B 25/008* (2013.01)

(58) Field of Classification Search
CPC ..... G08B 13/08
See application file for complete search history.

(56) References Cited

U.S. PATENT DOCUMENTS

| | | | | |
|---|---|---|---|---|
| 6,542,078 | B2 | 4/2003 | Script et al. | |
| 2007/0019077 | A1 | 1/2007 | Park | |
| 2008/0157964 | A1* | 7/2008 | Eskildsen | G08B 13/08 340/545.1 |
| 2013/0155242 | A1 | 6/2013 | Hevia et al. | |
| 2014/0313032 | A1* | 10/2014 | Sager | H04Q 9/00 340/539.17 |
| 2015/0308178 | A1* | 10/2015 | Warren | E05F 15/70 700/275 |
| 2016/0189496 | A1 | 6/2016 | Modi et al. | |
| 2016/0189511 | A1 | 6/2016 | Peterson et al. | |
| 2016/0267774 | A1 | 9/2016 | Janardhanan et al. | |

* cited by examiner

*Primary Examiner* — Omeed Alizada
(74) *Attorney, Agent, or Firm* — Husch Blackwell LLP

(57) ABSTRACT

Systems and methods are provided for protecting a bypassed zone in a security system or a connected home system. Some methods can include providing a portable sensor package device proximate to an open device in the bypassed zone of a monitored region, the portable sensor package device detecting motion in a coverage area of the portable sensor package device and a direction of the motion, the portable sensor package device refraining from triggering an alarm when the direction of the motion is from inside of the monitored region to outside of the monitored region, and the portable sensor package device triggering the alarm when the direction of the motion is from outside of the monitored region to inside of the monitored region.

20 Claims, 2 Drawing Sheets

SYSTEMS AND METHODS FOR PROTECTING A BYPASSED ZONE IN A SECURITY SYSTEM OR A CONNECTED HOME SYSTEM

FIELD

The present invention relates generally to security systems and connected home systems. More particularly, the present invention relates to systems and methods for protecting a bypassed zone in a security system or a connected home system.

BACKGROUND

Known security systems and connected home systems include detectors, such as PIR motion sensors, cameras, window/door contacts, carbon monoxide sensors, and the like. Furthermore, known security systems and connected home systems operate in a plurality of modes, such as an armed away mode, an armed stay mode, and a disarmed mode. For example, when operating in the armed stay mode, one zone in a monitored region, such as a perimeter zone, will be armed, and another zone in the monitored region, such as an interior zone, will be disarmed.

When a known security system or connected home system is operating in the armed stay mode, opening a door or a window in the perimeter zone of the monitored region will trigger an alarm. However, a user may need or want to completely or partially open the door or the window to allow fresh air from outside into the monitored region, to view outside of the monitored region, for example, responsive to hearing a noise outside of the door or the window, or for some other reason. Known security systems and connected home systems cannot distinguish between the user intentionally or mistakenly opening the door or the window and an intruder opening the door or the window. Therefore, to avoid triggering the alarm, the user must bypass sensors associated with the door or the window by accessing a control panel device of the security system or the connected home system directly or via a mobile device and selecting the sensors to bypass. This is a time consuming process and is not user friendly. Furthermore, after the sensors are bypassed, they are not armed, thereby creating a security risk, especially when the user forgets to remove the bypass and re-arm the sensors.

Additionally or alternatively, the user may need to arm the security system or the connected home from outside of the monitored region, including a zone in which a completely or partially open door or window is located. However, upon detecting the open door or window, the security system or the connected home system may not allow the user to arm the system.

In view of the above, there is a continuing, ongoing need for improved systems and methods.

DETAILED DESCRIPTION

Figure 1A:
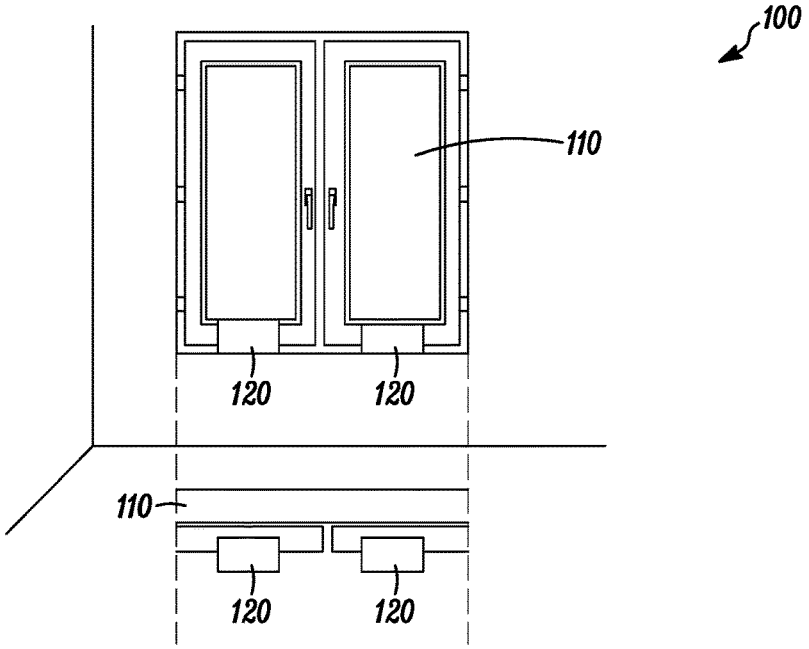
FIG. 1A is a block diagram of side and top views of a system in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include systems and methods for protecting a bypassed zone in a security system or a connected home system. For example, when the security system or the connected home system is operating in an armed stay mode, systems and methods disclosed herein can bypass a device, such as any type of door or window in an open state, or a device sensor associated with the device while continuing to monitor, secure, and protect the bypassed zone in which the device or the device sensor that is bypassed is located, for example, by transmitting notification messages to a user relating to detected activity in the bypassed zone.

In some embodiments, systems and methods disclosed herein can include a portable sensor package (PSP) device that can be temporarily or permanently placed in the bypassed zone, for example, on, in, or proximate to the device or the device sensor to be bypassed, and can detect motion and a direction of the motion. For example, the portable sensor package device can include a PSP sensor, such as a direction sensing motion detector, a PIR direction sensing motion detector, an IR transmitter and receiver, an IR obstacle sensor beam detector, or a camera with edge analytics that can detect the motion and the direction thereof within a field of view of the camera. Furthermore, in some embodiments, the PSP sensor can output a direction indication signal indicating the direction of the motion, such as motion from inside of a monitored region to outside of the monitored region or motion from outside of the monitored region to inside of the monitored region.

In operation, the portable sensor package device disclosed herein can be temporarily or permanently placed in the bypassed zone of the monitored region monitored by the security system or the connected home system and proximate the device, such as the door or the window, or the device sensor associated with the device in the bypassed zone. After such placement, the user can arm or disarm the bypassed zone as needed.

In some embodiments, a software application or program executing on a control panel device, a mobile device, a cloud server device, or a wearable device can cause a visual indication of a coverage area monitored by the portable sensor package device to be visually displayed on a user interface device associated with the control panel device, the mobile device, the cloud server device, or the wearable device. Additionally or alternatively, in some embodiments, a notification device associated with the portable sensor package device can provide or display a visual indication of the coverage area in the bypassed zone. Accordingly, the user can adjust the coverage area as needed by adjusting a position of the portable sensor package device.

When the bypassed zone is armed, systems and methods disclosed herein can associate the portable sensor package device with the bypassed zone, and the user can bypass the device or the device sensor in the bypassed zone. In some embodiments, systems and methods disclosed herein can associate the portable sensor package device with the bypassed zone responsive to manual user input received via the user interface device of the control panel device, the mobile device, the cloud server device, or the wearable device. Additionally or alternatively, in some embodiments, the portable sensor package device can detect the device sensor proximate thereto and transmit an instruction signal to the control panel device, the mobile device, the cloud server device, or the wearable device to automatically associate the portable sensor package device with the bypassed zone. In these embodiments, the portable sensor package device can include an indoor location sensing device, such as a BLE tag, and can identify its location based on a fixed or known location of the detected device sensor.

After the portable sensor package device is associated with the bypassed zone, the portable sensor package device can provide a trigger time delay, for example, 2-3 minutes, during which the portable sensor package device refrains from triggering any alarm. Accordingly, during the trigger time delay, the user can open the device without triggering an alarm. However, after expiration of the trigger time delay, the portable sensor package device can monitor the bypassed zone.

In some embodiments, a length of the trigger time delay can be configured by the user. For example, in some embodiments, the portable sensor package device can include a microphone to receive a voice command from the user to extend or reduce the trigger time delay.

While the portable sensor package device monitors the bypassed zone, the device can be in an open state. Upon detecting the motion in the bypassed zone, the portable sensor package device can detect the direction of the motion. For example, when the portable sensor package device determines that the direction of the motion is from inside of the monitored region to outside of the monitored region, the portable sensor package device can determine that the motion is likely the motion of an occupant of the monitored region and, therefore, does not trigger the alarm. However, when the portable sensor package device determines that the direction of the motion is from outside of the monitored region to inside of the monitored region, the portable sensor package device can determine that the motion is likely the motion of an intruder to the monitored region, and therefore, trigger the alarm. Additionally or alternatively, responsive to determining that the direction of the motion is from outside of the monitored region to inside of the monitored region, the portable sensor package device can transmit a notification signal, which the user can review and, responsive thereto, provide user input to trigger the alarm, when appropriate. For example, in some embodiments, the notification signal can be pushed to one or more connected devices, such as a connected speaker, television, mobile, phone, and the like.

In some embodiments, the portable sensor package device can be permanently mounted in the bypassed zone. In these embodiments, the user can bypass the bypassed zone or the permanently mounted portable sensor package device, and, after bypass, the permanently mounted portable package device can continue monitoring the bypassed zone. However, upon detection of a positive condition that would otherwise trigger the alarm, the permanently mounted portable sensor device can refrain from transmitting an alarm signal. Instead, responsive to detecting the positive condition, the permanently mounted package device can transmit the notification signal, which the user can review and, responsive thereto, provide user input to trigger the alarm, when appropriate.

Figure 1B:
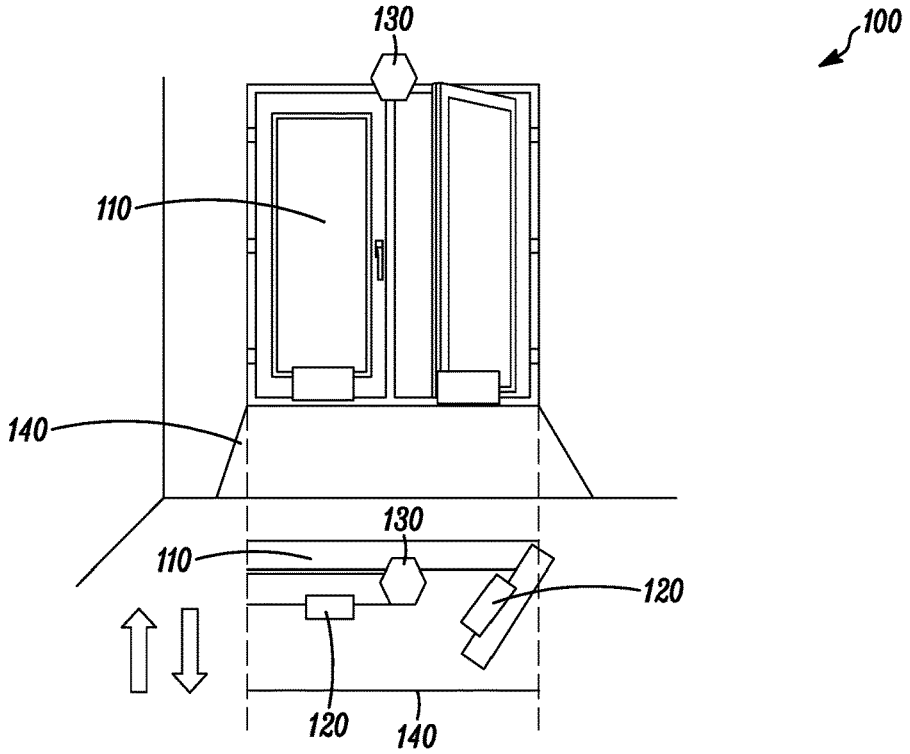
FIG. 1B is a block diagram of side and top views of a system in accordance with disclosed embodiments.

FIGS. 1A-1B are block diagrams of a system 100 in accordance with disclosed embodiments. As seen in the side and top views of the system 100 in FIG. 1A, the system 100 can include a device 110 (a window) and one or more device sensors 120 (window sensors) associated with the device 110 for monitoring the device 100 and an ambient area.

As seen in the side and top views of the system 100 in FIG. 1B, when a user wants to open the device 110, for example, for ventilation, the user can place a portable sensor package device 130 near the device 110 in a location to monitor activity and detect motion in a coverage area 140 around the device 110. After the portable sensor package device 130 is placed, systems and methods disclosed herein can associate the portable sensor package device 130 with a zone of the device 110, and the portable sensor package device 130 can start a trigger time delay during which the portable sensor package device 130 can refrain from triggering any alarm. That is, during the trigger time delay, the user can open the device 110 without the portable sensor package device 130 triggering the alarm.

After expiration of the trigger time delay, the portable sensor package device 130 can monitor the device 110 and the coverage area 130 with the device 110 in an open state. The portable sensor package device 130 can detect motion in the coverage area 130 and, upon such detection, determine a direction of the motion. When the portable sensor package device 130 determines that the direction of the motion is from inside of a monitored area associated with the device 110 to outside of the monitored area, the portable sensor package device 130 can refrain from triggering the alarm. However, when the portable sensor package device 130 determines that the direction of the motion is from outside of the monitored area to inside of the monitored area, the portable sensor package device 130 can trigger the alarm.

Figure 2:
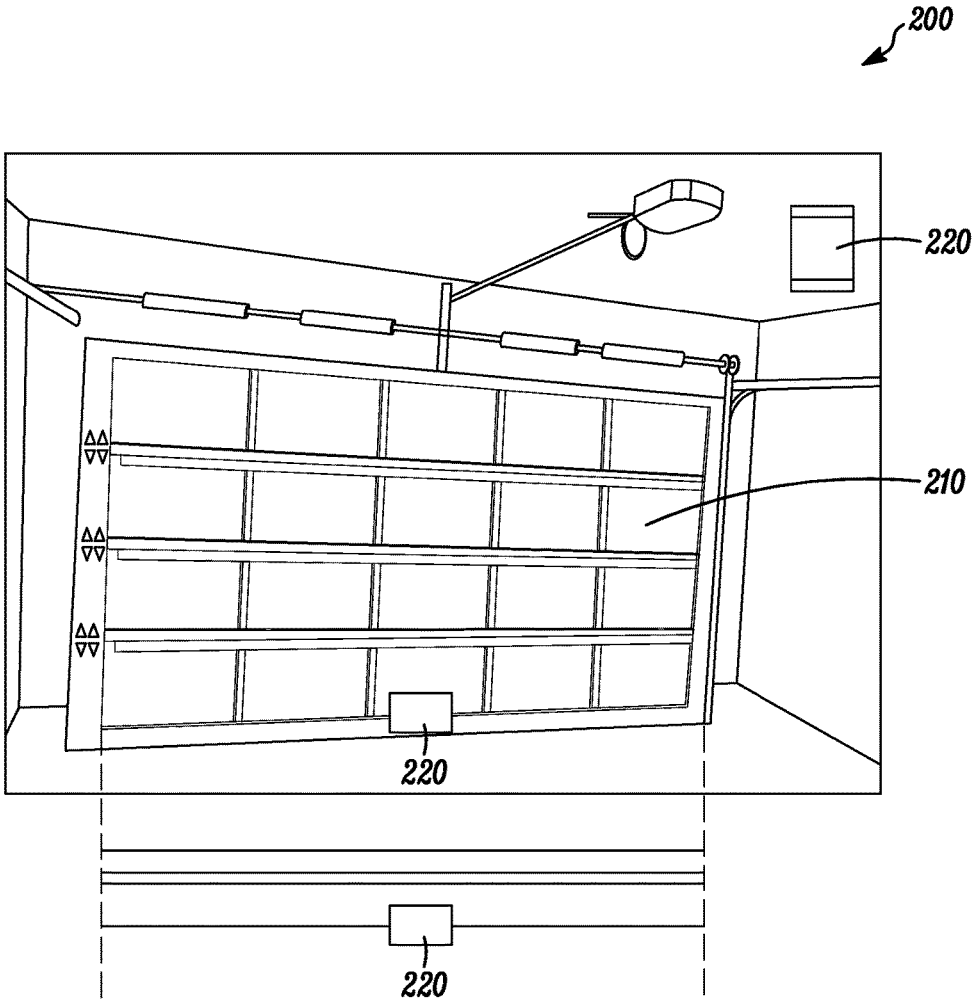
FIG. 2 is a block diagram of side and top views of a system in accordance with disclosed embodiments.

FIG. 2 is a block diagram of a system 200 in accordance with disclosed embodiments. As seen in the side and top views of the system 200 in FIG. 2, the system 200 can include a device 210 (a garage) and one or more permanently mounted device sensors 220 (garage door sensor, motion sensor) associated with the device 210 for monitoring the device 210 and an ambient area for activity and for detecting motion in a coverage area around the device 210. A user can bypass the device 210, one or more of the permanently mounted device sensors 220, or a zone in which the device 210 and the permanently mounted device sensors 220 are located. After bypass, when one or more of the permanently mounted device sensors 220 detects a positive condition that would otherwise trigger an alarm, the permanently mounted device sensor 220 can transmit a notification signal to solicit user input with instructions as to whether to trigger the alarm.

It is to be understood that the systems and methods as disclosed herein, including the portable sensor package device, can be implemented with a transceiver device, a PSP sensor, and a timing device, each of which can be in communication with control circuitry, one or more programmable processors, and executable control software as would be understood by one of ordinary skill in the art. In some embodiments, the transceiver device can communicate with the control panel device, the mobile device, the cloud server device, or the wearable device, the PSP sensor can detect motion and a direction thereof, and the timing device can start and stop the trigger time delay. Furthermore, in some embodiments, the control software can be stored on a transitory or non-transitory computer readable medium, including, but not limited to local computer memory, RAM, optical storage media, magnetic storage media, flash memory, and the like, and some or all of the control circuitry, the programmable processors, and the control software can execute and control at least some of the methods described herein.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

responsive to receiving first user input, bypassing a zone of a monitored region;

when the zone is bypassed, a security device associated with the zone refraining from triggering an alarm in response to detecting an occurrence of a security condition monitored by the security device;

associating a portable sensor package device proximate to the security device with the zone;

the portable sensor package device detecting motion in a coverage area of the portable sensor package device and a direction of the motion;

when the direction of the motion is from inside of the monitored region to outside of the monitored region, the portable sensor package device refraining from triggering the alarm; and when the direction of the motion is from outside of the monitored region to inside of the monitored region, the portable sensor package device triggering the alarm independently of the security device.

2. The method of claim 1 further comprising a security system or a connected home system monitoring the monitored region and operating in an armed stay mode.

3. The method of claim 1 further comprising temporarily or permanently providing the portable sensor package device proximate to the security device.

4. The method of claim 1 wherein the portable sensor package device includes a direction sensing motion detector.

5. The method of claim 1 further comprising displaying a visual indication of the coverage area on a user interface device of a control panel device, a mobile device, a cloud server device, or a wearable device.

6. The method of claim 1 further comprising providing a visual indication of the coverage area in the zone.

7. The method of claim 1 further comprising receiving second user input and, responsive thereto, associating the portable sensor package device with the zone.

8. The method of claim 1 further comprising:

moving the portable sensor package device to a location proximate to the security device; and responsive to the moving, the portable sensor package device detecting the security device or a sensor associated with the security device proximate to the portable sensor package device and, responsive thereto, transmitting an instruction signal to a control panel device, a mobile device, a cloud server device, or a wearable device to associate the portable sensor package device with the zone.

9. The method of claim 1 further comprising:

providing a trigger time delay; and the portable sensor package device refraining from triggering the alarm during the trigger time delay.

10. The method of claim 1 wherein triggering the alarm includes the portable sensor package device transmitting a notification signal to solicit user input as to whether to trigger the alarm.

11. A system comprising:

a security device associated with a zone of a monitored region;

a sensor device proximate to the security device in the zone;

a programmable processor; and executable control software stored on a non-transitory computer readable medium, wherein, responsive to receiving first user input, the programmable processor and the executable control software bypass the zone, wherein, when the zone is bypassed, the programmable processor and the executable control software refrain from triggering an alarm in response to the security device detecting an occurrence of a security condition monitored by the security device, wherein the sensor device detects motion in a coverage area of the sensor device and a direction of the motion, wherein, when the direction of the motion is from inside of the monitored region to outside of the monitored region, the programmable processor and the executable control software refrain from triggering the alarm, and wherein, when the direction of the motion is from outside of the monitored region to inside of the monitored region, the programmable processor and the executable control software trigger the alarm independently of the security device.

12. The system of claim 11 further comprising a security system or a connected home system, wherein the security system or the connected home system monitors the monitored region and operates in an armed stay mode.

13. The system of claim 11 wherein the sensor device is temporarily or permanently placed proximate to the security device.

14. The system of claim 11 wherein the sensor device includes a direction sensing motion detector.

15. The system of claim 11 further comprising:

a transceiver device, wherein the programmable processor and the executable control software instruct the transceiver device to transmit an instruction signal to display a visual indication of the coverage area on a user interface device of a control panel device, a mobile device, a cloud server device, or a wearable device.

16. The system of claim 11 further comprising:

a notification device, wherein the programmable processor and the executable control software instruct the notification device to display a visual indication of the coverage area in the zone.

17. The system of claim 11 further comprising:

a user interface device; and a transceiver device, wherein the user interface device receives second user input, and responsive thereto, the transceiver device to transmits an instruction signal to a control panel device, a mobile device, a cloud server device, or a wearable device to associate the sensor device with the zone.

18. The system of claim 11 further comprising:

a transceiver device, wherein, when the sensor device is moved to a location proximate to the security device, the sensor device detects the security device proximate to the sensor device, and responsive thereto, the transceiver device transmits an instruction signal to a control panel device, a mobile device, a cloud server device, or a wearable device to associate the sensor device with the zone.

19. The system of claim 11 further comprising:

a timing device, wherein the timing device starts and stops a trigger time delay, and wherein the programmable processor and the executable control software refrain from triggering the alarm during the trigger time delay.

20. The system of claim 11 further comprising:

a transceiver device, wherein the programmable processor and the executable control software trigger the alarm by instructing the transceiver device to transmit a notification signal to solicit user input as to whether to trigger the alarm.

* * * * *